US006464325B2

(12) United States Patent
Silverbrook

(10) Patent No.: US 6,464,325 B2
(45) **Date of Patent: *Oct. 15, 2002**

(54) INK JET PRINTHEAD INCORPORATING LATERALLY DISPLACEABLE ACTUATOR MECHANISMS

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

This patent is subject to a terminal disclaimer.

(21) Appl. No.: 09/864,342

(22) Filed: May 25, 2001

(65) Prior Publication Data

US 2001/0026298 A1 Oct. 4, 2001

Related U.S. Application Data

(63) Continuation-in-part of application No. 09/113,061, filed on Jul. 10, 1998, now Pat. No. 6,247,794.

(30) Foreign Application Priority Data

Jul. 15, 1997 (AU) ..... PO8049

(51) Int. Cl.[7] ..... B41J 2/015; B41J 2/14; B41J 2/04

(52) U.S. Cl. ..... 347/20; 347/20; 347/48

(58) Field of Search ..... 347/20, 44, 47, 347/54, 48

(56) References Cited

U.S. PATENT DOCUMENTS

| | | | | |
|---|---|---|---|---|
| 5,612,723 A | | 3/1997 | Shimura et al. | |
| 6,215,206 B1 | * | 4/2001 | Chitayat | 310/12 |
| 6,231,158 B1 | * | 5/2001 | Hiyane et al. | 347/37 |
| 6,302,528 B1 | * | 10/2001 | Silverbrook | 347/54 |

* cited by examiner

*Primary Examiner*—Michael Nghiem
*Assistant Examiner*—An H. Do

(57) ABSTRACT

An ink jet print head has a plurality of nozzle arrangements. Each nozzle arrangement defines a nozzle chamber from which ink can be ejected. Each nozzle chamber is configured so that the ink is ejected from each nozzle chamber in a first direction with respect to each nozzle chamber. Each nozzle arrangement has an ink ejection mechanism that is operatively arranged with respect to each nozzle arrangement, for ejecting ink from each nozzle chamber. The ink ejection mechanisms are each displaceable in a second direction relative to the nozzle chambers, the second direction being substantially at right angles to said first direction, to facilitate the ejection of ink from the nozzle chamber.

10 Claims, 3 Drawing Sheets

INK JET PRINTHEAD INCORPORATING LATERALLY DISPLACEABLE ACTUATOR MECHANISMS

RELATED APPLICATIONS AND CROSS REFERENCES

This is a continuation-in-part application of U.S. Pat. No. 6,247,794. U.S. Pat. Nos. 6,247,794, 6,234,610, 6,264,306, 6,238,040, 6,188,415, 6,227,654 and 6,209,989 are hereby incorporated by reference.

FIELD OF THE INVENTION

This invention relates to an ink jet printhead that incorporates laterally displaceable actuator mechanisms.

BACKGROUND OF THE INVENTION

The Applicant has invented a page width printhead which is capable of generating text and images of resolutions as high as 1600 dpi.

The printhead is manufactured in accordance with a technique that is based on integrated circuit fabrication. An example of such a technique is that which is presently used for the fabrication of micro electro-mechanical systems. It will be appreciated by those skilled in the art that such techniques are carried out largely in a planar fashion. This means that the layers of material are deposited and then selectively etched to define the required structure. This fabrication technique is well known and will therefore not be described in further detail here.

The Applicant has filed many patent applications covering the use of these techniques to fabricate the page width printhead mentioned above. The page width printhead can incorporate up to 84 000 nozzle arrangements. Each nozzle arrangement includes a micro electro-mechanical actuator that is displaceable to eject ink from a nozzle chamber of each nozzle arrangement.

An important factor in this field of technology is chip size. The larger the chip, the more expensive the printhead. Accordingly, it is important that the chip be kept as thin as possible. Conventionally, the actuators are positioned to be displaceable in a direction corresponding to that of the direction of drop ejection. Drop ejection usually takes place in a direction substantially normal to a plane in which the chip is positioned. It follows that the chip must be made thick enough to accommodate movement of the actuators. This can result in the chip being excessively thick and thus costly.

The Applicant has devised a way of overcoming this problem with the present invention.

SUMMARY OF THE INVENTION

According to the invention, there is provided an ink jet print head which comprises a substrate;

at least one nozzle arrangement positioned on the substrate,, the, or each, nozzle arrangement defining a nozzle chamber from which ink can be ejected, the nozzle chamber being configured so that the ink is ejected from the, or each, nozzle chamber in a first direction that is substantially normal to the substrate, and the, or each, nozzle arrangement having an ink ejection mechanism that is operatively arranged with respect to the, or each, nozzle arrangement, for ejecting ink from the, or each, nozzle chamber, wherein the ink ejection mechanism is displaceable in a second direction relative to the, or each, nozzle chamber, the second direction being in a plane substantially parallel to the substrate.

The invention will now be described, by way of example only, with reference to the accompanying drawings. The specific nature of the following description is not to be construed as limiting in any way the scope of the above summary

DETAILED DESCRIPTION OF THE INVENTION

Figure 1:
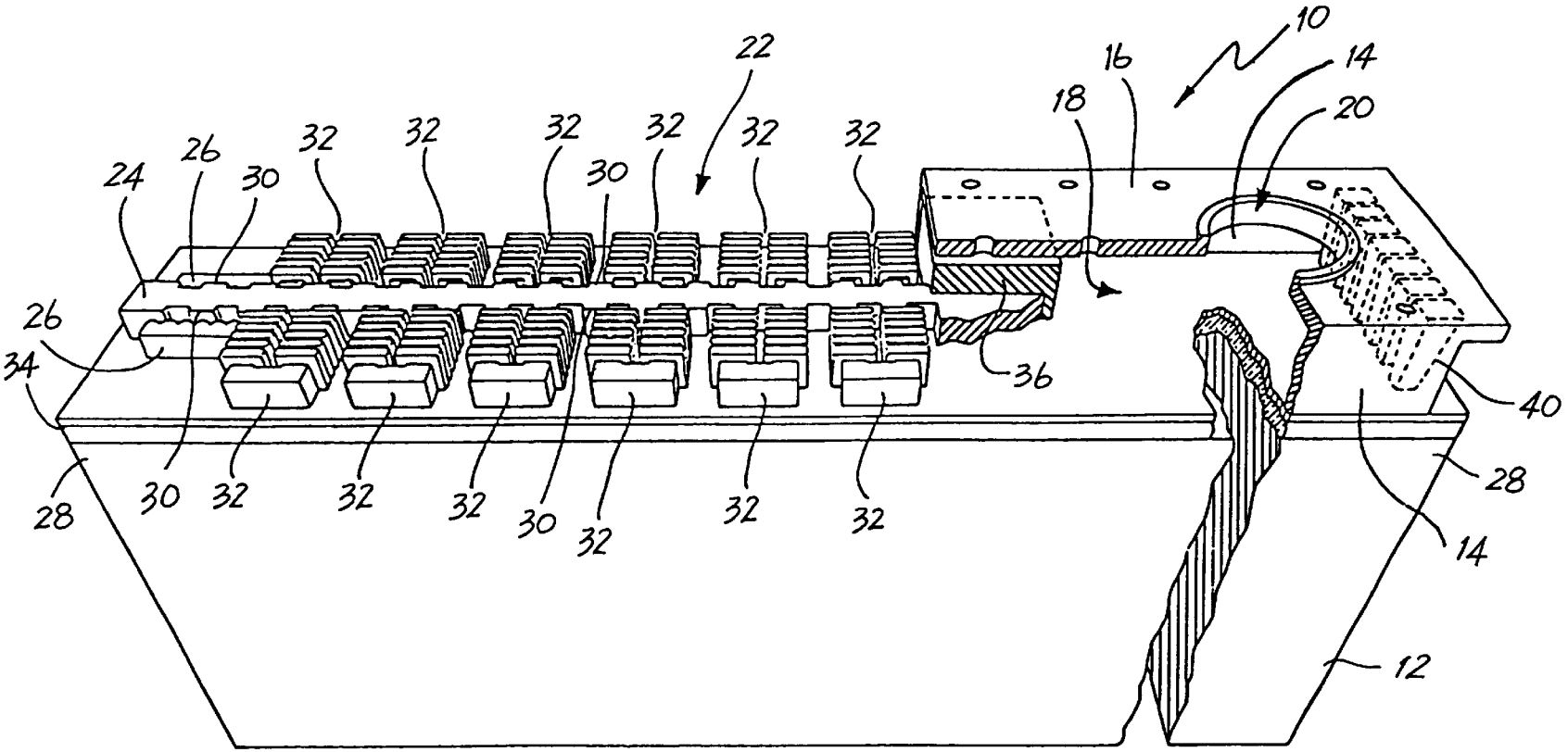
FIG. 1 shows a partly sectioned view of a nozzle arrangement of a first embodiment of a printhead, in accordance with the invention.

In FIG. 1, reference numeral 10 generally indicates a nozzle arrangement of a first embodiment of a printhead, in accordance with the invention.

The printhead is in the form of a page width printhead. It follows that those of ordinary skill in the field of printhead manufacture will appreciate that the nozzle arrangment 10 is one of many such nozzle arrangements. For ease of reference, one such nozzle arrangement is shown.

As set out in the preamble, the printhead is manufactured using integrated circuit fabrication technology. In particular, the printhead is manufactured with techniques that are used for the manufacture of micro electro-mechanical systems. Such techniques use a process of deposition and subsequent etching to achieve a final product. The Applicant has covered these manufacturing techniques as applied to printheads in other patents and patent applications. It is therefore not within the scope of this specification to detail such steps.

In this particular example, the nozzle arrangement 10 includes a wafer substrate 12. A pair of opposed side walls 14, an end wall 38 and a roof portion 16 are positioned on the substrate 12 to define a nozzle chamber 18. The roof portion 16 defines an ink ejection port 20.

The end wall 38 is defined by a filter structure 40 so that ink entering the nozzle chamber 18 is filtered.

The nozzle arrangement 10 includes an ink ejection mechanism in the form of a linear actuator 22. The linear actuator 22 includes a magnetic rod 24 that is positioned in a plane substantially parallel to a plane in which the substrate 12 is positioned. A pair of spaced guide formations 26 are arranged on the substrate 12, with the magnetic rod 24 being displaceably positioned between the guide formations 26. The guide formations 26 and the rod 24 are configured so that the rod 24 is restrained to be displaced linearly between opposed edges 28 of the substrate 12.

The magnetic rod 24 defines a number of spaced magnetic poles 30 along its length. A number of electromagnetic devices 32 are positioned on each side 34 of the magnetic rod 24. The electromagnetic devices 32 and the magnetic poles 30 are configured so that selective activation of the electromagnetic devices 32 results in movement of the magnetic rod 24. In particular, the electromagnetic devices 32 are connected to drive circuitry, indicated generally at 34, so that stepped motion of the magnetic rod 24 can be achieved. It will be appreciated that the drive circuitry 34 can be connected to a sophisticated control system so that exact backwards and forwards control of the magnetic rod 24 can be achieved.

A plunger 36 is mounted on an end of the magnetic rod 24 to be received between the side walls 14 of the nozzle chamber 18. The plunger 36 is displaceable, via actuation of the rod 24 towards and away from the end wall 28 to eject ink from the ink ejection port 20.

Figure 2:
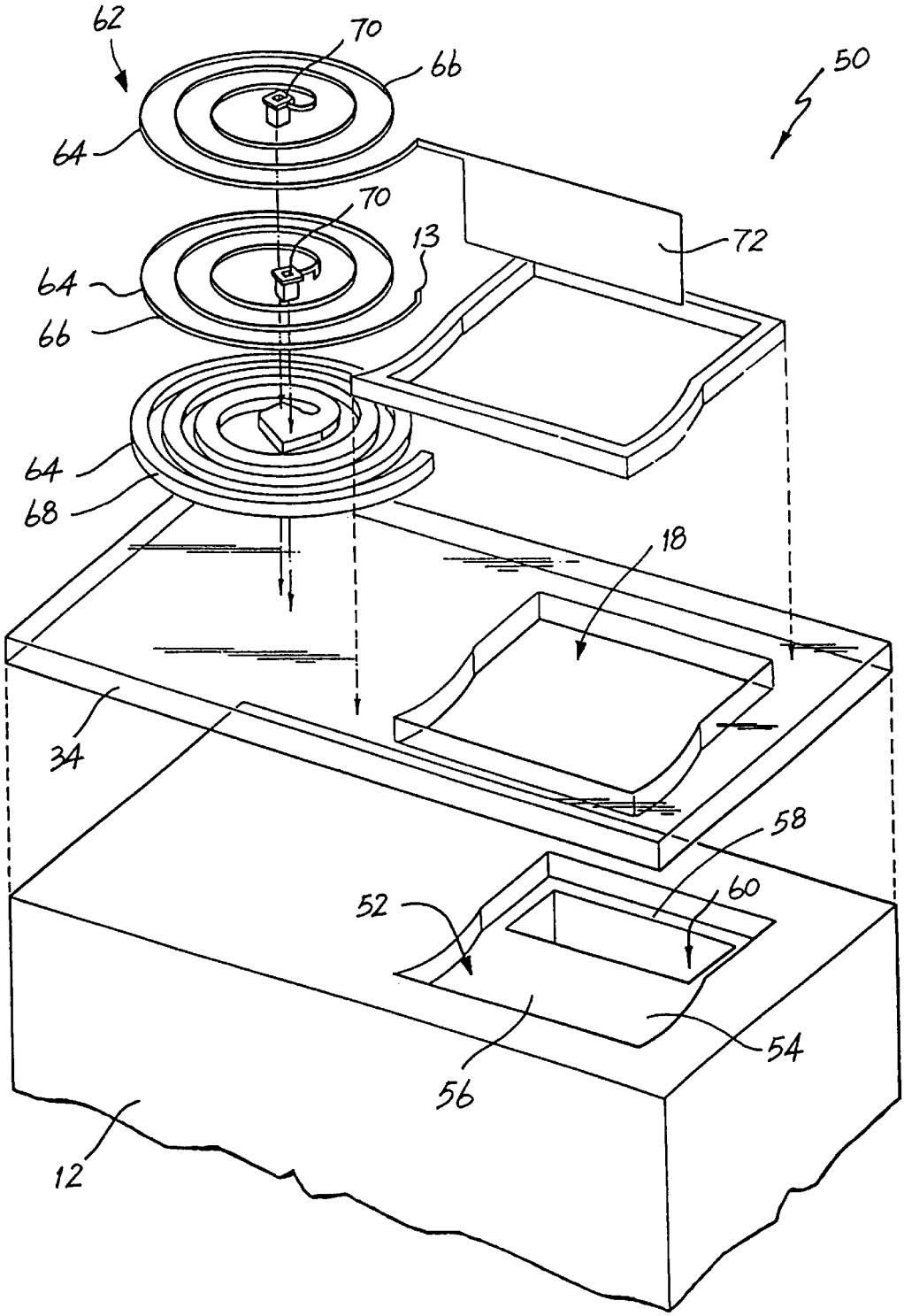
FIG. 2 shows an exploded view of a nozzle arrangement of a second embodiment of a printhead, in accordance with the invention.

In FIG. 2, reference numeral 50 generally indicates a nozzle arrangement of a second embodiment of a printhead, in accordance with the invention. With reference to FIG. 1, like reference numerals refer to like parts, unless otherwise specified.

In this particular example, the nozzle chamber 18 is defined by a recess 52 that is etched in the substrate 12. The recess 52 is generally rectangular in cross section. A floor 54 of the recess 52 has a first portion 56 with an arcuate profile and a second portion 58 that defines an inlet 60.

The nozzle arrangement 50 has a coiled actuator 62. The coiled actuator 62 includes a coiled, composite arm 64. The arm 64 is composed of a heating element 66 embedded in a thermal expansion material, in this case polytetrafluoroethylene (PTFE) 68. PTFE has a coefficient of thermal expansion which is such that PTFE can do work when heated to expand. The heating element 66 is embedded in the PTFE 68 such that, upon heating of the PTFE 68 by the heating element 66, the PTFE 68 expands so that the composite arm 64 uncoils to a degree.

The heating element 66 is connected to the drive circuitry 34 at 70. It follows that, with the drive circuitry 34 connected to a suitable control system, selective partial uncoiling of the arm 64 can be achieved. PTFE is inherently resilient. It follows that, when the PTFE 68 cools, the arm 64 returns to its coiled state.

An ink displacement member in the form of a paddle 72 is connected to an end of the arm 64. The paddle 72 is received in the nozzle chamber 18 above the inlet 60 when the arm 64 is in its coiled state. When the arm 64 uncoils, as set out above, the paddle 72 is driven across the nozzle chamber 18 into a position above the first portion 56 of the floor 54 of the recess 52. The arcuate profile of the first portion 56 facilitates the ejection of ink from the nozzle chamber 18.

Figure 3:
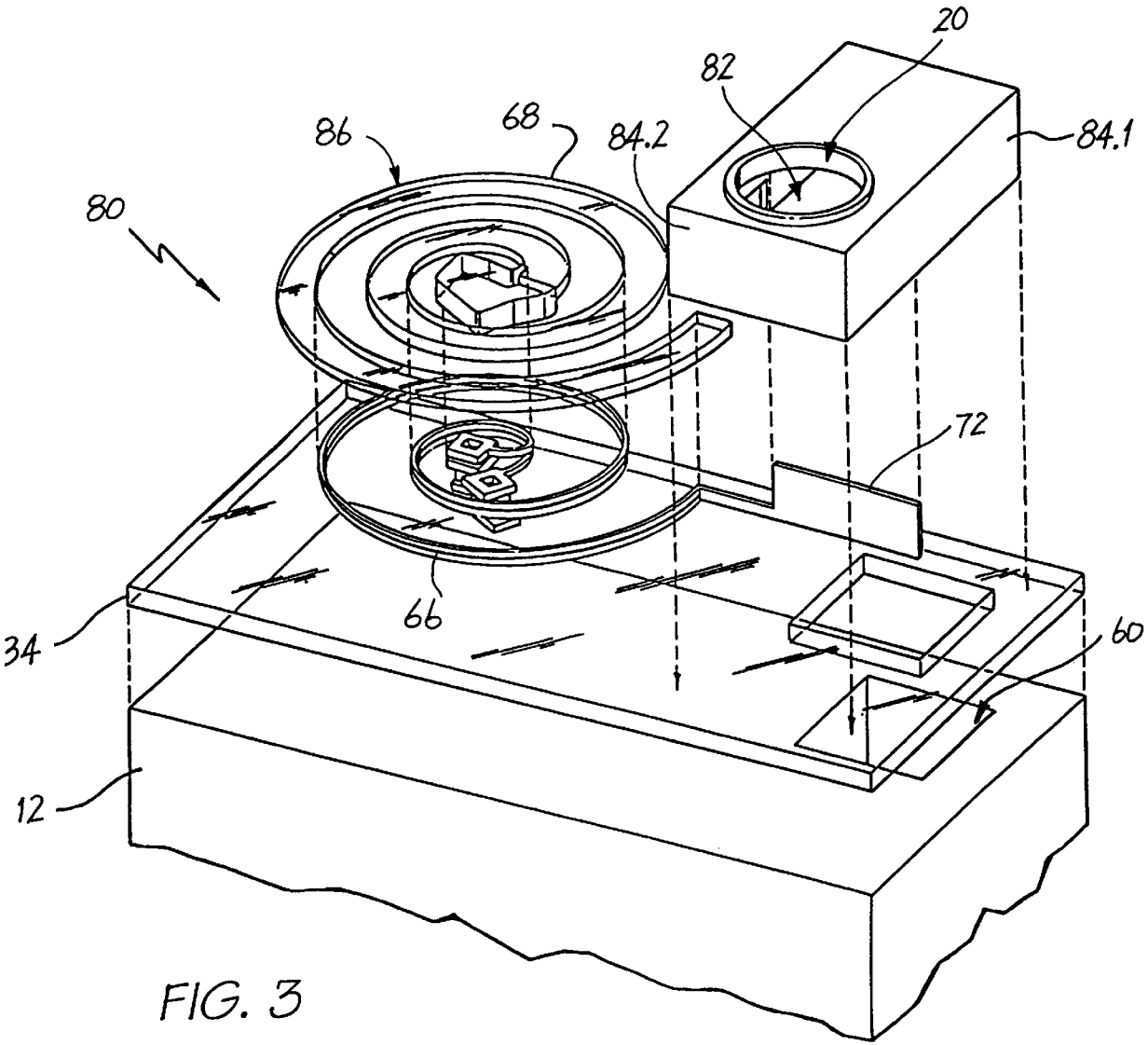
FIG. 3 shows an exploded view of a nozzle arrangement of a third embodiment of a printhead, in accordance with the invention.

In FIG. 3, reference numeral 80 generally indicates a nozzle arrangement of a third embodiment of a printhead, in accordance with the invention. With reference to FIGS. 1 and 2, like reference numerals refer to like parts, unless otherwise specified.

The nozzle arrangement 80 includes a nozzle chamber 82 that is defined by four side walls 84 and a roof wall 86. The roof wall 86 defines an ink ejection port 88 from which ink is ejected, in use.

The nozzle chamber 18 is rectangular so that an opposed pair of walls 84.1 are major walls, while the remaining walls 84.2 are minor walls. The inlet 60 is positioned proximate one of the minor walls 84.2 while the ejection port 88 is positioned proximate the other, opposed, minor wall 84.2.

The nozzle arrangement 80 also includes a coiled actuator 86. In this example, the paddle 72 is received in the nozzle chamber 18 via a slot 88 defined in one of the walls 84. In particular, the paddle 72 is positioned above the inlet 60 when the arm 64 is in its coiled condition and is driven towards said opposed minor wall 84.2 when the arm 64 is partially uncoiled. This serves to pressurize the ink in the chamber 82, thereby ejecting the ink from the chamber 82.

In all three of the examples given, it is important to note that the actuators are displaced in a plane substantially normal to the plane of ink ejection. As set out in the preamble, this form of printhead is manufactured in a planar fashion. The fact that the actuators are arranged to be displaced in this fashion, results in a substantial simplification of the fabrication process. The primary reason for this is that the whole actuator is positioned on the substrate, rather than extending into the substrate.

Also as set out in the preamble, the cost of a page width printhead chip increases dramatically with the thickness of the chip. The primary reason for this is that the chip must be of a length sufficient to span at least part of a printing medium. The present invention, as indicated in the examples described above, provides a means whereby these costs can be greatly alleviated. This is achieved by providing actuators which do not require a minimum thickness of the chip in which to operate.

I claim:

1. An ink jet printhead that is manufactured in accordance with an integrated circuit fabrication technique, the printhead comprising a substrate; and at least one nozzle arrangement positioned on the substrate, the, or each, nozzle arrangement defining a nozzle chamber from which ink can be ejected, the nozzle chamber being configured so that the ink is ejected from the, or each, nozzle chamber in a first direction that is substantially normal to the substrate, and the, or each, nozzle arrangement having an ink ejection mechanism that is operatively arranged with respect to the, or each, nozzle arrangement, for ejecting ink from the, or each, nozzle chamber, wherein the ink ejection mechanism is displaceable in a second direction relative to the, or each, nozzle chamber, the second direction being in a plane substantially parallel to the substrate.

2. An ink jet printhead as claimed in claim 1, which comprises a plurality of nozzle arrangements incorporated on a chip that is the product of the integrated circuit fabrication technique.

3. An ink jet printhead as claimed in claim 2, in which the nozzle arrangements are micro electro-mechanical components.

4. An ink jet printhead as claimed in claim 2, in which the chip is dimensioned to span a printing medium of a predetermined width, so that the printhead defines a page width printhead.

5. An ink jet printhead as claimed in claim 2, in which each ink ejection mechanism includes an actuator that is displaceable on the application of an actuating signal in a plane which is substantially parallel to a plane in which the chip is oriented.

6. An ink jet printhead as claimed in claim 5, in which each actuator includes an ink displacement member that is displaceable within each respective nozzle chamber, each ink displacement member being shaped so that, on displacement of the ink displacement member in said second direction, ink is ejected from the nozzle chamber in said first direction.

7. An ink jet printhead as claimed in claim 5, in which each nozzle arrangement includes an ink ejection port that is in fluid communication with the nozzle chamber, each ejection port being positioned so that the ink is ejected in said first direction.

8. An ink jet printhead as claimed in claim 5, in which each actuator includes a plunger that is displaceable in each respective nozzle chamber to apply a pressure to the ink within the nozzle chamber, thereby ejecting the ink from the nozzle chamber.

9. An ink jet printhead as claimed in claim 8, in which the actuator is in the form of a linear actuator that is linearly displaceable in said second direction, to drive the plunger between a position in which the plunger is spaced from a wall of the nozzle chamber and a position in which the plunger is adjacent the wall of the nozzle chamber.

10. An ink jet printhead as claimed in claim 8, in which the actuator includes a coiled portion that is positioned in a plane that is substantially parallel to a plane of the chip, the coiled portion being displaceable between a coiled and a partially uncoiled position, on the application of an actuating signal, with the plunger being positioned on an outer end of the coiled portion to be displaceable when the coiled portion moves between the coiled and partially uncoiled conditions.

* * * * *